US008729883B2

(12) United States Patent
Wong et al.

(10) Patent No.: US 8,729,883 B2
(45) Date of Patent: May 20, 2014

(54) CURRENT SOURCE WITH LOW POWER CONSUMPTION AND REDUCED ON-CHIP AREA OCCUPANCY

(75) Inventors: Yanyi L. Wong, Bellevue, WA (US); Agustinus Sutandi, Issaquah, WA (US)

(73) Assignee: Synopsys, Inc., Mountain View, CA (US)

( * ) Notice: Subject to any disclaimer, the term of this patent is extended or adjusted under 35 U.S.C. 154(b) by 195 days.

(21) Appl. No.: 13/171,491

(22) Filed: Jun. 29, 2011

(65) Prior Publication Data

US 2013/0002228 A1 Jan. 3, 2013

(51) Int. Cl.
*G05F 3/04* (2006.01)

(52) U.S. Cl.
USPC ..... 323/312

(58) Field of Classification Search
USPC ..... 323/311–317; 327/538–543
See application file for complete search history.

(56) References Cited

U.S. PATENT DOCUMENTS

| | | | | |
|---|---|---|---|---|
| 5,640,681 | A * | 6/1997 | Barrett et al. | 323/315 |
| 6,465,998 | B2 * | 10/2002 | Sirito-Olivier | 323/315 |
| 7,915,882 | B2 * | 3/2011 | Hellums | 323/312 |
| 2009/0009150 | A1 * | 1/2009 | Arnold | 323/312 |
| 2009/0039861 | A1 * | 2/2009 | Wang | 323/313 |
| 2010/0007322 | A1 * | 1/2010 | Huang | 323/312 |

* cited by examiner

*Primary Examiner* — Nguyen Tran
(74) *Attorney, Agent, or Firm* — Baker Botts L.L.P.

(57) ABSTRACT

A current source with low power consumption and reduced on-chip area occupancy. The current source for providing a constant current to a load includes a first circuit that generates a reference current. The first circuit includes a first plurality of interconnected transistors. The current source also includes a characteristic resistor, coupled to the first circuit, that determines value of the reference current. The current source further includes a second circuit and a third circuit. The second circuit, coupled to the first circuit and to the load, generates an output current that is identical to the reference current. The second circuit includes a second plurality of interconnected transistors. The third circuit, coupled to the first circuit, drives a multiple of the reference current into the characteristic resistor. The third circuit includes a third plurality of interconnected transistors.

23 Claims, 7 Drawing Sheets

CURRENT SOURCE WITH LOW POWER CONSUMPTION AND REDUCED ON-CHIP AREA OCCUPANCY

TECHNICAL FIELD

Embodiments of the disclosure relate to a current source that provides a constant current to a load.

BACKGROUND

In an electronic system, there is often a need to provide a flow of current into a load such that the current is constant almost regardless of an impedance of the load. For example, to set an amplifier at a particular operating point, a bias current can be applied. The bias current has to be maintained at a constant level. In one example, a constant bias current is needed for the control of oscillators and timing signals. In another example, a constant bias current is needed is for generation of high-voltage control signals used in a non-volatile memory, for example a flash memory.

A current source that can provide a constant current typically includes transistors that provide a current gain. Usually, the current gain varies substantially across instances of transistors. Therefore the current source needs to be designed such that an output current of the current source is independent of the current gain of the transistors. A current mirror is used to produce the constant current of the desired level.

Currently, electronics need to consume less current so as to maximize battery life. Hence, current sources need to supply reliable and low levels of the current. By Ohm's law, a low current can be produced by the current source by increasing a size of a resistor that determines a level of current. However, increasing the size of the resistor consumes more area on an integrated circuit. Also, a certain type of resistor is more likely to be subject to variation of resistance with temperature, thereby compromising a constancy of the current that is provided by the current source.

Hence, there is a need for a current source that consumes less power, occupies less area in an integrated circuit, and is stable against temperature fluctuations and other environmental factors, for example power supply voltage fluctuations and manufacturing variations.

SUMMARY

An example of a current source for providing a constant current to a load includes a first circuit that generates a reference current. The first circuit includes a first plurality of interconnected transistors. The current source also includes a characteristic resistor coupled to the first circuit. The characteristic resistor determines value of the reference current. The current source further includes a second circuit coupled to the first circuit and to the load. The second circuit generates an output current that is identical to the reference current. The second circuit includes a second plurality of interconnected transistors. Further, the current source includes a third circuit coupled to the first circuit. The third circuit drives a multiple of the reference current into the characteristic resistor. The third circuit includes a third plurality of interconnected transistors.

Another example of a current source for providing a constant current to a load includes a first circuit that generates a reference current. The current source also includes a second circuit coupled to the first circuit and to the load. The second circuit generates an output current that is identical to the reference current. The current source further includes a characteristic resistor coupled to the second circuit. The characteristic resistor determines value of the reference current. Further, the current source includes a third circuit coupled between the first circuit and the second circuit. The third circuit drives a multiple of the output current into the characteristic resistor. Moreover, the current source includes a resistor coupled to the first circuit.

An example of a method of providing a constant current to a load includes generating a reference current. The method also includes driving a multiple of the reference current into a characteristic resistor. The method further includes determining a value of the reference current by the characteristic resistor based on the reference current and the multiple of the reference current. Further, the method includes generating an output current that is identical to the reference current. Moreover, the method includes providing the output current to the load.

BRIEF DESCRIPTION OF THE DRAWINGS

In the accompanying figures, similar reference numerals may refer to identical or functionally similar elements. These reference numerals are used in the detailed description to illustrate various embodiments and to explain various aspects and advantages of the present disclosure.

DETAILED DESCRIPTION OF THE EMBODIMENTS

In one embodiment, current source, as used in the disclosure, refers to a device that produces a constant and predetermined level of current regardless of a load to which the device delivers the current. In one example, the current source includes two circuits; a first circuit producing a reference current, and a second circuit reproducing a multiple of level of the current in the first circuit, and delivering such current into the load. In one example, the multiple equals unity.

In one embodiment, current mirror, as used in the disclosure, refers to a circuit designed to copy a current through one active device by controlling the current in another active device of the circuit, keeping an output current constant. In one example, the second circuit is a current mirror to the first circuit, and generates the output current that is identical to the reference current in the first circuit.

In one embodiment, characteristic resistor, as used in the disclosure, refers to a resistor that is a component of the current mirror and that determines the level of the current generable by the current mirror.

In one embodiment, volt-equivalent of temperature ($U_T$), as used in the disclosure, is a voltage level associated with a temperature, and is defined to equal the temperature (T) in degrees Kelvin multiplied by the Boltzmann constant k ($k=1.38\times10^{-23}$ in System International (SI) units) divided by the charge q of an electron ($q=1.6\times10^{-19}$ Coulombs). Thus volt-equivalent of room temperature, which is 300 degrees Kelvin, can be calculated as 26 millivolts.

The current generable by the current source is determined by the characteristic resistor. To generate low levels of current, Ohm's Law can be applied and size of the characteristic resistor can be increased. However, such an increase results in undesirable effects, for example increase in on-chip area. The present disclosure offers a solution to the problem of needing to use a large characteristic resistor by adding a circuit referred to herein as an auxiliary current mirror. The present disclosure is described in context of current mirrors that are of Vittoz-style architecture and current mirrors that are of Widlar-style architectures. It will apparent to one of ordinary skill in the art that system of using the auxiliary current mirror in order to reduce the size of the characteristic resistor applies to a current mirror of an architecture that uses the characteristic resistor. Similarly, the disclosure applies to multiple semiconductor technologies. The present disclosure is described exemplarily for complementary metal oxide semiconductor (CMOS) and bipolar junction transistor (BJT) technologies.

Figure 1:
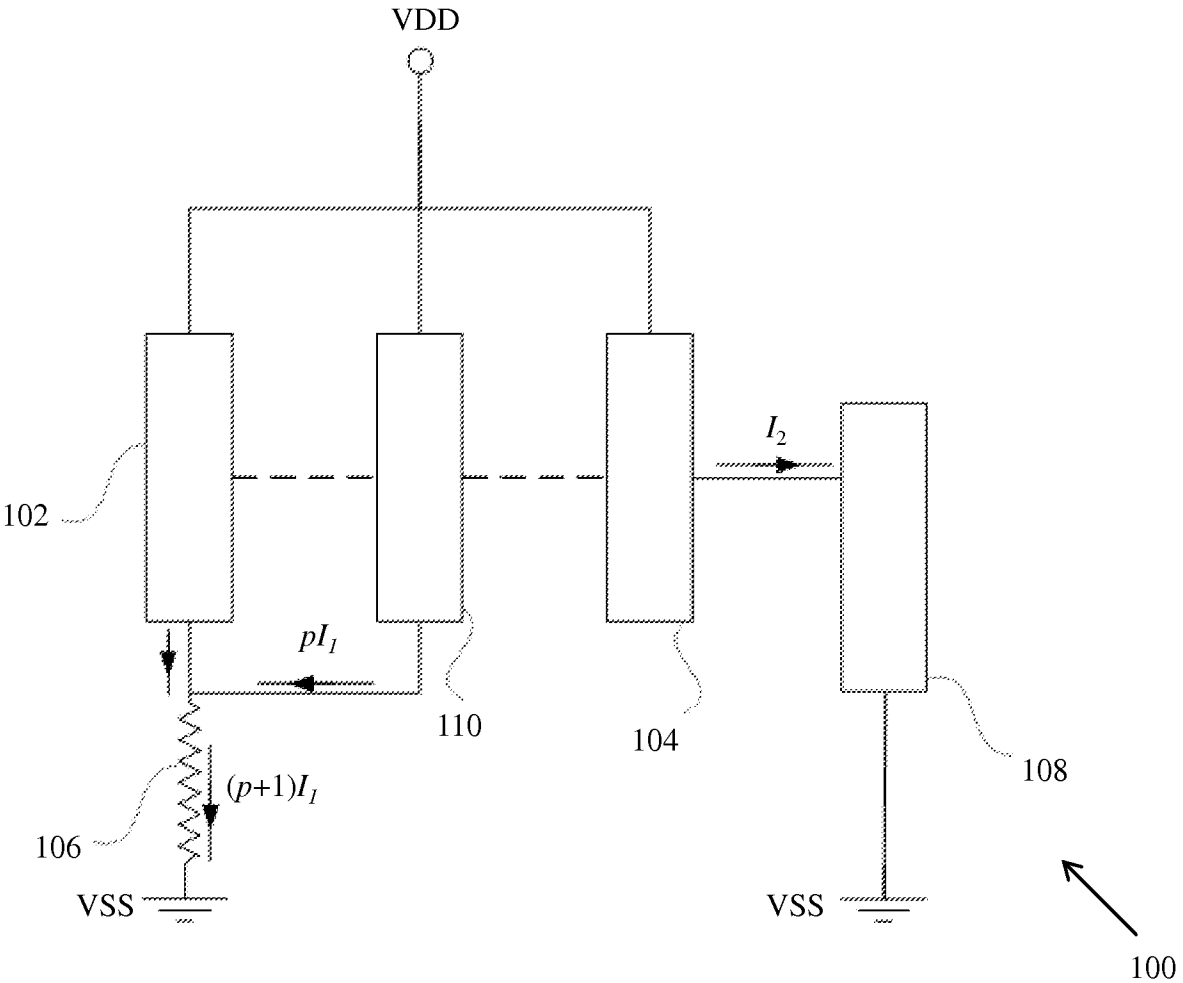
FIG. 1 is a block diagram illustrating a current source of Vittoz-style architecture, in accordance with one embodiment.

FIG. 1 is a block diagram illustrating a current source 100 of Vittoz-style architecture, in accordance with one embodiment.

The current source 100 achieves a desired value of output current without increasing size of a characteristic resistor $R_0$ 106. The current source 100 includes a first circuit 102, a second circuit 104, a characteristic resistor 106, a third circuit 110, and a load 108. The first circuit 102 is coupled between a power supply (VDD) and the characteristic resistor 106. The third circuit 110 is coupled to the power supply, and to the first circuit 102. The second circuit 104 is coupled to the power supply, and between the third circuit 110 and the load 108. The characteristic resistor 106 and the load 108 are further coupled to a ground supply (VSS). The first circuit 102 includes a first plurality of interconnected transistors, the second circuit 104 includes a second plurality of interconnected transistors, and the third circuit 110 includes a third plurality of interconnected transistors. The first circuit 102 generates a reference current $I_1$ that flows through the characteristic resistor 106. The second circuit 104 mirrors the first circuit 102. The third circuit 110 is an auxiliary current mirror that drives a current which equals a multiple p of the reference current $I_1$ into the characteristic resistor 106. The current flowing through the characteristic resistor 106 is then p+1 times the reference current $I_1$, which sustains voltage across the characteristic resistor 106 by using a value of resistance that is p+1 times lower. A current $I_2$ which is a pre-designed multiple of the reference current $I_1$, is generated by the second circuit 104. The current $I_2$ is further provided to the load 108.

Figure 2:
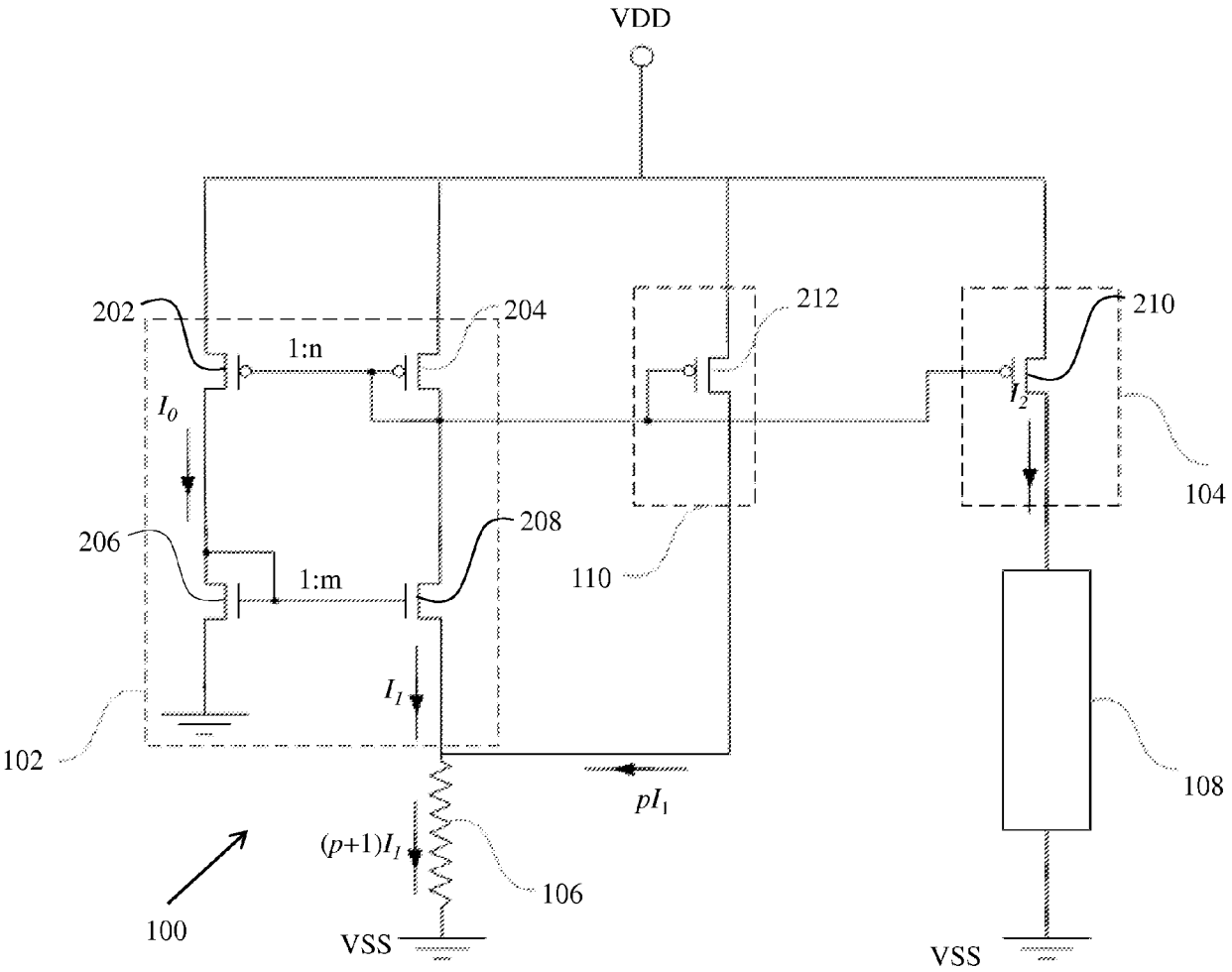
FIG. 2 is a schematic diagram of a current source of Vittoz-style architecture implemented in complementary metal oxide semiconductor (CMOS) technology, in accordance with one embodiment.

FIG. 2 is a schematic diagram of the current source 100 of Vittoz-style architecture implemented in complementary metal oxide semiconductor (CMOS) technology, in accordance with one embodiment.

The first plurality of interconnected transistors in the first circuit 102 includes a first p-type metal oxide semiconductor (PMOS) transistor 202, a second PMOS transistor 204, a first n-type metal oxide semiconductor (NMOS) transistor 206, a second NMOS transistor 208. The first PMOS transistor 202 has a source coupled to the power supply. The second PMOS transistor 204 has a gate coupled to a gate of the first PMOS transistor 202 and a source coupled to the power supply. The first NMOS transistor 206 has a drain coupled to a drain of the first PMOS transistor 202 and a source coupled to the ground supply. The second NMOS transistor 208 has a gate coupled to a gate of the first NMOS transistor 206, a drain coupled to a drain of the second PMOS transistor 204, and a source coupled to the characteristic resistor 106. The second plurality of interconnected transistors in the second circuit 104 includes a PMOS transistor 210. The PMOS transistor 210 has a gate coupled to the gate of the first PMOS transistor 202, a source coupled to the power supply, and a drain coupled to the load 108. The third plurality of interconnected transistors in the third circuit 110 includes a PMOS transistor 212. The PMOS transistor 212 has a gate coupled to the gate of the first PMOS transistor 202, a source coupled to the power supply, and a drain coupled between the source of the second NMOS transistor 208 and the characteristic resistor 106. In some embodiments, the first PMOS transistor 202, the second PMOS transistor 204, the first NMOS transistor 206, and the second NMOS transistor 208 can have identical characteristics irrespective of different sizes.

The first PMOS transistor 202, the second PMOS transistor 204, the first NMOS transistor 206, and the second NMOS transistor 208, in the first circuit 102, together generate the reference current $I_1$, value of which is determined by the characteristic resistor 106. The first PMOS transistor 202 and the second PMOS transistor 204 differ in sizes based on a ratio of 1:n, where n is a first integer value. Similarly, the first NMOS transistor 206 and the second NMOS transistor 208 differ in sizes based on a ratio of 1:m, where m is a second integer value. In the present disclosure, size of each transistor is defined as ratio of width of the transistor to length of the transistor. The PMOS transistor 210 generates the current $I_2$ which is an output current provided to the load 108. The PMOS transistor 212 further is the auxiliary current mirror that drives a current that equals p times the reference current $I_1$ into the characteristic resistor 106. The PMOS transistor 212 is p times larger than the second PMOS transistor 204, and has similar gate voltage and source voltage to the second PMOS transistor 204.

Gates of the first PMOS transistor 202 and the second PMOS transistor 204 are at a voltage lower than respective sources, hence biasing the first PMOS transistor 202 and the second PMOS transistor 204 to operate in a saturation mode. In the saturation mode, a current $I_0$ and the reference current $I_1$ that flow respectively through the first PMOS transistor 202 and the second PMOS transistor 204 are proportional to the sizes of respective transistors and otherwise depend only on gate-to-source voltages. As the gate-to-source voltages of the first PMOS transistor 202 and the second PMOS transistor 204 are identical, the current $I_0$ and the reference current $I_1$ are in the ratio of the sizes of the transistors, that is, $I_0/I_1=1/n$.

Gate-to-source voltages of the first NMOS transistor 206 and the second NMOS transistor 208 are lower than threshold voltage of the first NMOS transistor 206 and the second NMOS transistor 208, hence biasing the first NMOS transistor 206 and the second NMOS transistor 208 to operate in weak inversion mode. Typically, the current through a transistor in weak inversion mode is proportional to size of the transistor, to negative exponential of gate voltage of the transistor, and to the negative exponential of source voltage of the transistor divided by the volt-equivalent of temperature. Gate voltages of the first NMOS transistor 206 and the second NMOS transistor 208 are identical, whereas the source voltage of the first NMOS transistor 206 is zero volts and the source voltage of the second NMOS transistor 208 is, by Ohms law, $R_0I_1$. $R_0$ is value of the characteristic resistor 106. Therefore, the ratio of the current $I_0$ and the reference current $I_1$ through the first NMOS transistor 206 and the second NMOS transistor 208, which is $I_0/I_1$, and the ratio of the current $I_0$ and the reference current $I_1$ through the first PMOS transistor 202 and the second PMOS transistor 204, equals the ratio of the sizes of the first NMOS transistor 206 and the second NMOS transistor 208 multiplied by the negative exponential of $R_0I_1/U_T$. In mathematical terms, relationship between $I_0/I_1$ and the sizes of the first NMOS transistor 206 and the second NMOS transistor 208 can be given in equation 1 below:

$$\frac{I_0}{I_1} = \frac{1}{m}e^{R_0I_1/U_T} = \frac{1}{n}, \tag{1}$$

where m indicates the ratio of the size of the second NMOS transistor 208 to that of the first NMOS transistor 206.

The PMOS transistor 212 mirrors the second PMOS transistor 204. On rearrangement of equation 1, the characteristic resistor 106, of value $R_0$, is given as $$R_0 = \frac{U_T}{(p+1)I_1}\ln\frac{m}{n}, \tag{2}$$

$R_0$, for the level of reference current $I_1$, is p+1 times lower. Using the characteristic resistor 106 of decreased size, reduces overall area occupancy of the current source 100. In one example, quantity $U_T \ln(m/n)$, which equals the voltage across the characteristic resistor 106, is maintained at around 70 to 80 millivolts. To generate the reference current of 1800 nanoamperes, the PMOS transistor 212 which is p=20 times the size of the second PMOS transistor 204, and the characteristic resistor 106 of 2.1 kiloohms need be used. Alternately, for similar value of the characteristic resistor 106, the current source 100 allows for generation of currents that are p+1 lower. For example, for the characteristic resistor 106 of 45 kiloohms and p=20, the lowest reference current generable by the current source 100 is 80 millivolts/(21×45 kiloohms)=85 nanoamperes. The lowest reference current is a constant current that is required for several applications, for example on-chip oscillators, timing and control signals for non-volatile memories. Low level of the current needed by such applications is hence generated without increasing size of the characteristic resistor $R_0$.

The current $I_2$, which is the output current that flows into the load 108 and is equal to the reference current $I_1$ except for a constant of proportionality, equals the ratio of the sizes of the second PMOS transistor 204 and the PMOS transistor 210.

As the reference current depends on the volt-equivalent of temperature $U_T$, and since $U_T$ is proportional to the temperature, it follows that the reference current can rise or fall with the temperature. In order to decrease variation with the temperature of the output current, it is desirable to use the characteristic resistor 106 where the resistance increases directly proportional with the temperature. It is easier to find materials with resistivity that have a suitable temperature coefficient, that is, rise linearly with the temperature, when the value of the characteristic resistor 106 is less. Thus, the present disclosure, using a decreased value of the characteristic resistor 106, provides reliable constancy of the output current across the temperature.

The present disclosure can be implemented in different semiconductor technologies. In one example, for a bipolar junction transistor (BJT) technology, PMOS transistors in FIG. 2 can be replaced with PNP transistors and NMOS transistors can be replaced with NPN transistors.

Figure 3:
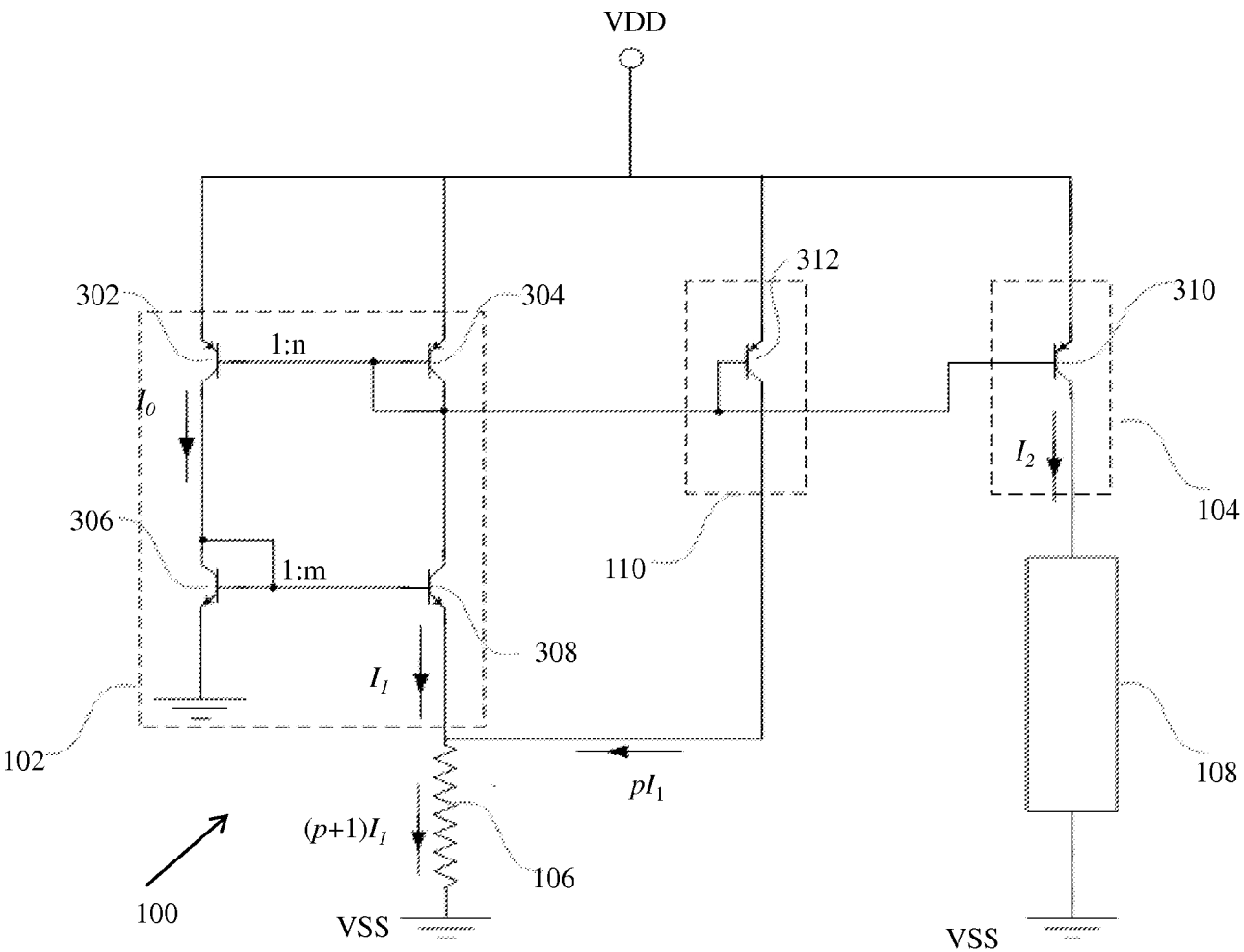
FIG. 3 is a schematic diagram of a current source of Vittoz-style architecture implemented in bipolar junction transistor (BJT) technology, in accordance with one embodiment.

FIG. 3 is a schematic diagram of the current source 100 of Vittoz-style architecture implemented in the BJT technology, in accordance with one embodiment.

PMOS transistors in FIG. 2 can be replaced with PNP transistors, for example a first PNP transistor 302, a second PNP transistor 304, a PNP transistor 310, and a PNP transistor 312. Further, NMOS transistors in FIG. 2 can be replaced with NPN transistors, for example a first NPN transistor 306, and a second NPN transistor 308. The PNP transistors in FIG. 3 operate similar to the PMOS transistors in FIG. 2, and the NPN transistors in FIG. 3 operate similar to the NMOS transistors in FIG. 2.

The PNP transistors and the NPN transistors are biased to be in forward-active mode.

Figure 4:
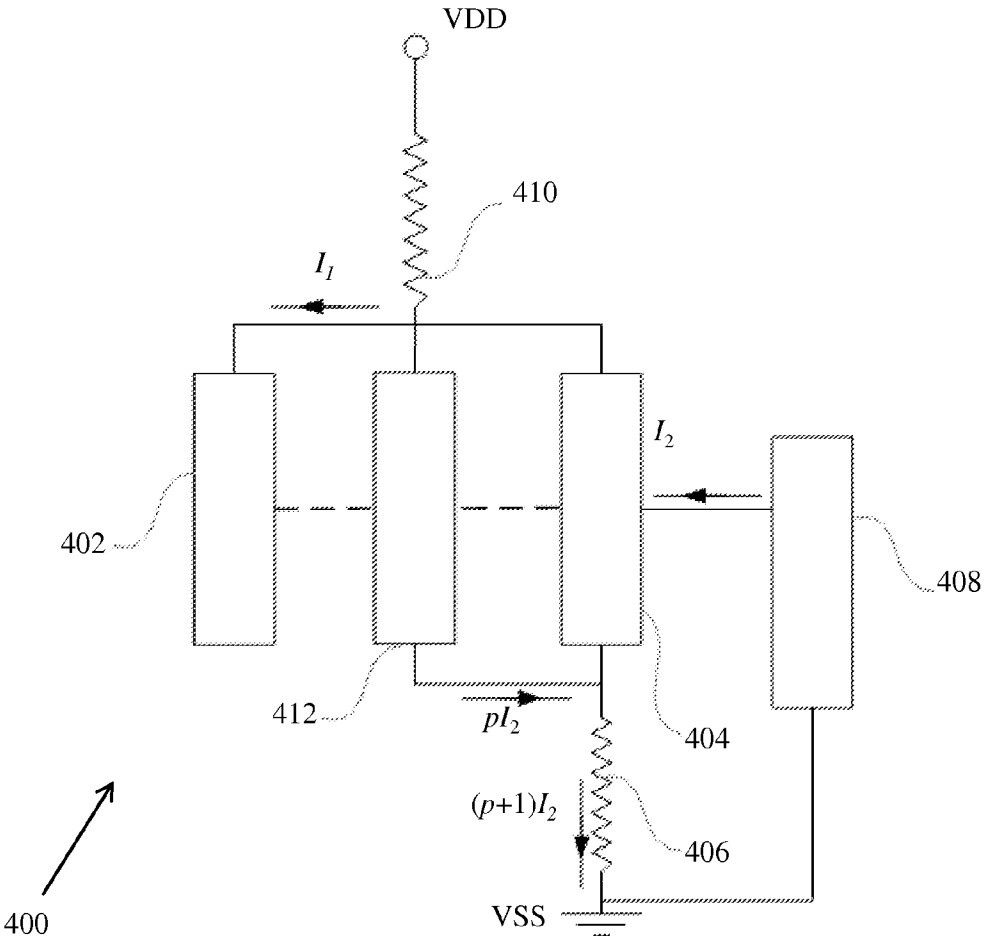
FIG. 4 is a block diagram illustrating a current source of Widlar-style architecture, in accordance with one embodiment.

FIG. 4 is a block diagram illustrating a current source 400 of Widlar-style architecture, in accordance with one embodiment.

The current source 400 includes a first circuit 402, a second circuit 404, a characteristic resistor 406, a resistor 410, a third circuit 412, and a load 408. The first circuit 402 is coupled to the power supply (VDD) via the resistor 410, and to the third circuit 412. The second circuit 404 is coupled between the resistor 410 and the characteristic resistor 406, and to the load 408. The third circuit 412 is coupled between the resistor 410 and the characteristic resistor 406, and between the first circuit 402 and the second circuit 404. The characteristic resistor 406 and the load 408 are further coupled to a ground supply (VSS).

In some embodiments, the resistor 410 can be replaced with an input current source.

The first circuit 402 generates a reference current $I_1$. The second circuit 404 mirrors the first circuit 402. The current $U_2$ which is a pre-designed multiple of the reference current $I_1$, is generated by the second circuit 404. The third circuit 412 is an auxiliary current mirror that directs a current which equals a multiple p of the current $I_2$ into the characteristic resistor 406, thereby allowing reduction of the value of the characteristic resistor 406, or alternately, allowing reduction of lowest generable output current, the current $I_2$. The current flowing through the characteristic resistor 406 is then p+1 times the current $I_2$. The current $I_2$ is further provided to the load 408.

Figure 5A:
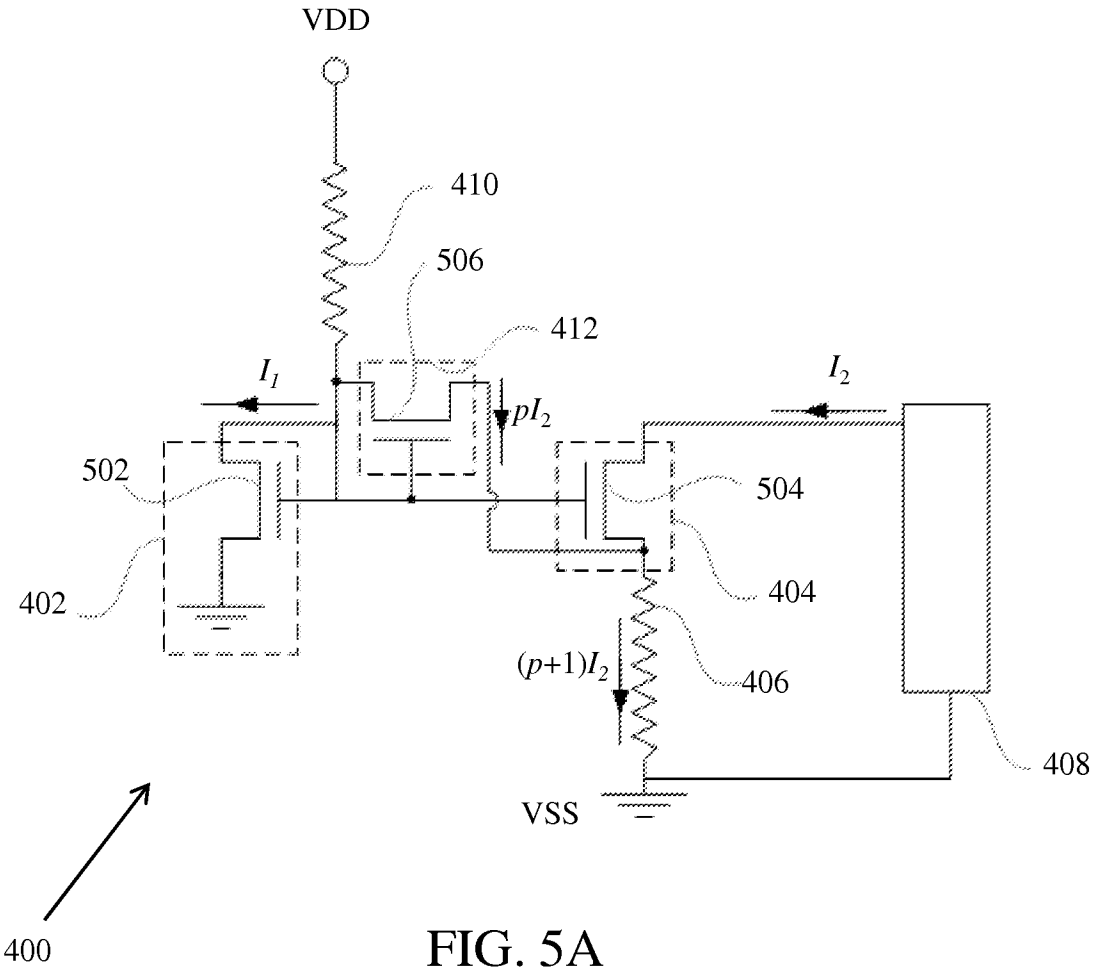
FIG. 5A is a schematic diagram of a current source of Widlar-style architecture implemented in complementary metal oxide semiconductor (CMOS) technology, in accordance with one embodiment.

FIG. 5A is a schematic diagram of the current source 400 of Widlar-style architecture implemented in complementary metal oxide semiconductor (CMOS) technology, in accordance with one embodiment.

The first circuit 402 includes an NMOS transistor 502, the second circuit 404 includes an NMOS transistor 504, and the third circuit 412 includes an NMOS transistor 506. The NMOS transistor 502 has a drain coupled to the power supply via the resistor 410, a gate coupled to a gate of the NMOS transistor 504 and to a gate of the NMOS transistor 506, and a source coupled to the ground supply. The NMOS transistor 504 has a drain coupled to the load 408, and a source coupled to the characteristic resistor 406. The NMOS transistor 506 has a drain coupled to the resistor 410, and a source coupled to the characteristic resistor 406.

The NMOS transistor 506 that serves as the auxiliary current mirror is a multiple p times higher than the NMOS transistor 504. The output current which is the current $I_2$ is generable by the current source 400 of FIG. 5A and is given by equation (3) if size of the NMOS transistor 502 is equal to size of the NMOS transistor 504:

$$I_2 = \frac{U_T}{(p+1)R_0}\ln\left(\frac{I_1}{I_2}\right), \tag{3}$$

where $R_0$ denotes the value of the characteristic resistor 406, and $I_1$ is the value of the reference current that is determined using the resistor 410. Equation 3 is also applicable when p is set to zero, that is, simulating a situation where the auxiliary current mirror is brought to null. By thus comparing equation 3 under non-zero and zero values of p, it is determined that the current source 400 delivers a p-fold reduction in the value of the characteristic resistor 406, or a p-fold reduction in the lowest generable output current $I_2$.

Figure 5B:
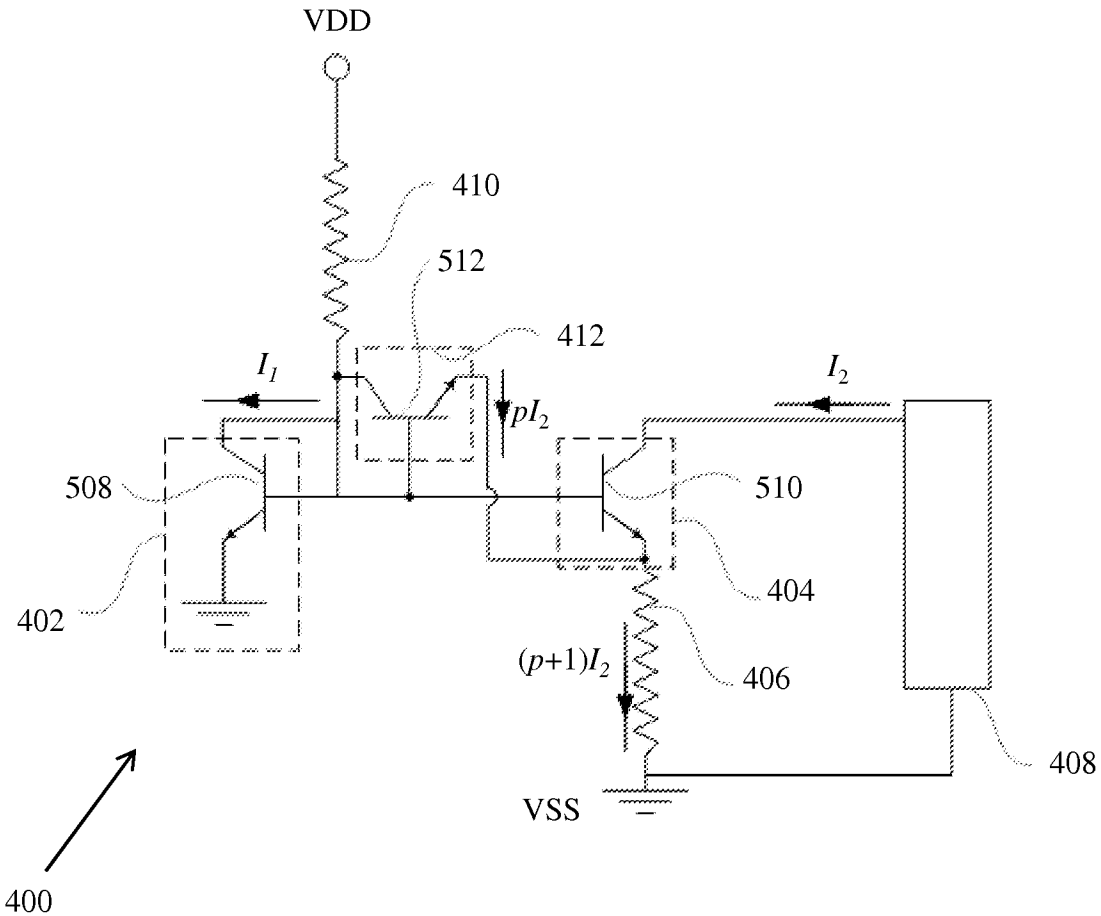
FIG. 5B is a schematic diagram of a current source of Widlar-style architecture implemented in bipolar junction transistor (BJT) technology, in accordance with one embodiment.

FIG. 5B is a schematic diagram of the current source 400 of Widlar-style architecture implemented in bipolar junction transistor (BJT) technology, in accordance with one embodiment.

The first circuit 402 includes an NPN transistor 508, the second circuit 404 includes an NPN transistor 510, and the third circuit 412 includes an NPN transistor 512. The NPN transistor 508 has a drain coupled to the power supply via the resistor 410, a gate coupled to a gate of the NPN transistor 510 and to a gate of the NPN transistor 512, and a source coupled to the ground supply. The NPN transistor 510 has a drain coupled to the load 408, and a source coupled to the characteristic resistor 406. The NPN transistor 512 has a drain coupled to the resistor 410, and a source coupled to the characteristic resistor 406.

The NPN transistor 512 that serves as the auxiliary current mirror is a multiple p times higher than the NPN transistor 510. The output current which is the current $I_2$ is generable by the current source 400 of FIG. 5B and is given by the following equation:

$$I_2 = \frac{U_T}{(p+1)R_0\left(1+\frac{1}{\beta}\right)}\ln\left(\frac{I_1}{I_2}\right), \tag{4}$$

where $R_0$ denotes the value of the characteristic resistor 406, $I_1$ is the value of the reference current that is determined using the resistor 410, and β is characteristic gain of the NPN transistor 508, the NPN transistor 510 and the NPN transistor 512. The value of β is usually between 50 and 200 and is similar for each transistor in FIG. 5B, due to being manufactured on one semiconductor die. Equation 4 is also applicable when p is set to zero, that is, simulating a situation where the auxiliary current mirror is brought to null. By thus comparing equation 4 under non-zero and zero values of p, it is determined that the current source 400 delivers a p-fold reduction in the value of the characteristic resistor 406, or a p-fold reduction in the lowest generable output current $I_2$.

The present disclosure, which uses an auxiliary current mirror to drive current into a characteristic resistor, can be implemented on different current source architectures, including Widlar-style architecture.

Figure 6:
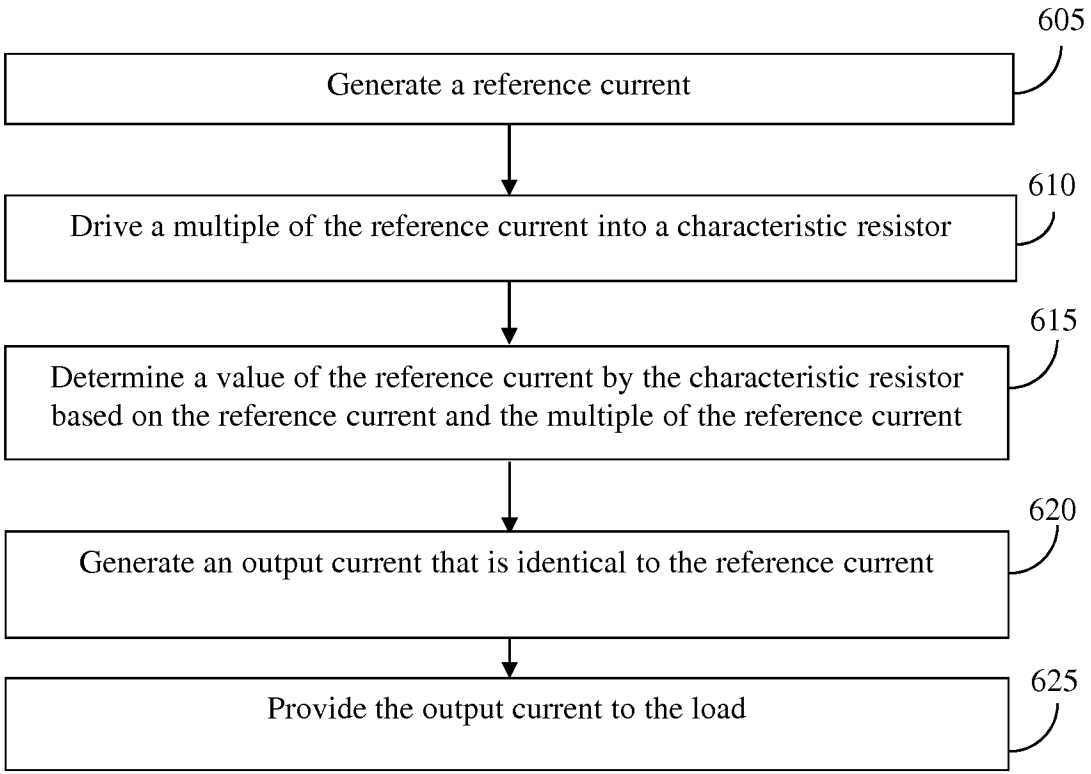
FIG. 6 is a flow diagram illustrating a method of providing a constant current to a load, in accordance with one embodiment.

FIG. 6 is a flow diagram illustrating a method of providing a constant current to a load by a current source, for example the current source 100, in accordance with one embodiment.

At step 605, a reference current is generated. The reference current can be generated by a first circuit that includes a first plurality of interconnected transistors, for example p-type metal oxide semiconductor (PMOS) transistors and n-type metal oxide semiconductor (NMOS) transistors.

At step 610, a multiple of the reference current is driven into the characteristic resistor by a third circuit. The third circuit can include a third plurality of interconnected transistors, for example a PMOS transistor.

In some embodiments, a multiple of an output current is driven into the characteristic resistor by the third circuit.

At step 615, a value of the reference current is determined by a characteristic resistor based on the reference current and the multiple of the reference current.

At step 620, the output current that is identical to the reference current is generated. The output current is generated by a second circuit that includes a second plurality of interconnected transistors, for example another PMOS transistor.

At step 625, the output current is provided to the load. The current source hence achieves a desired value of the output current without increasing size of the characteristic resistor.

Use of the current source, as described in the present disclosure, enables generation of low yet stable levels of current. By construction the current source occupies low on-chip area, consumes less power, and provides reliable constancy of current across temperature variations. The current source can be implemented in different semiconductor technologies. The present disclosure applies to one or more current mirror architectures having output current determined by a characteristic resistor.

The foregoing description sets forth numerous specific details to convey a thorough understanding of embodiments of the disclosure. However, it will be apparent to one skilled in the art that embodiments of the disclosure may be practiced without these specific details. Some well-known features are not described in detail in order to avoid obscuring the disclosure. Other variations and embodiments are possible in light of above teachings, and it is thus intended that the scope of disclosure not be limited by this Detailed Description, but only by the Claims.

What is claimed is:

1. A method comprising:

by a first circuit, generating a reference current;

by a second circuit coupled to the first circuit and a load, providing to the load an output current that depends on the reference current;

by the second circuit, providing to a characteristic resistor a sink current that is approximately equal to the output current, wherein the characteristic resistor has a first end directly coupled to the second circuit and a second end configured to be coupled to a ground supply;

by a third circuit coupled to the first and second circuits and the first end of the characteristic resistor, driving a multiple of the output current into the first end of the characteristic resistor; and by an input resistor having a first end coupled to the first circuit and a second end configured to be coupled to a power supply, determining a value of the reference current.

2. The method of claim 1, wherein the second circuit comprises a current mirror to the first circuit, and the third circuit comprises an auxiliary current mirror to the first circuit.

3. The method of claim 1, wherein the first circuit comprises a first metal oxide semiconductor (MOS) transistor having a drain and a gate coupled to the first end of the input resistor and a source configured to be coupled to the ground supply.

4. The method of claim 3, wherein the second circuit comprises a second MOS transistor having a gate coupled to the gate of the first MOS transistor, a drain coupled to the load, and a source coupled to the first end of the characteristic resistor.

5. The method of claim 4, wherein the third circuit comprises a third MOS transistor having a gate coupled to the gate of the first MOS transistor, a drain coupled to the drain of the first MOS transistor, and a source coupled to the source of the second MOS transistor.

6. The method of claim 1, wherein the first circuit comprises a first bipolar junction transistor (BJT) having a collector and a base coupled to the first end of the input resistor and an emitter configured to be coupled to the ground supply.

7. A current source comprising:

a first circuit configured to generate a reference current;

a second circuit coupled to the first circuit and configured to:

be coupled to a load;

provide to the load an output current that depends on the reference current; and provide to a characteristic resistor a sink current that is approximately equal to the output current;

the characteristic resistor, having a first end directly coupled to the second circuit and a second end configured to be coupled to a ground supply;

a third circuit coupled to the first and second circuits and the first end of the characteristic resistor, wherein the third circuit is configured to drive a multiple of the output current into the first end of the characteristic resistor; and an input resistor having a first end coupled to the first circuit and a second end configured to be coupled to a power supply, wherein the input resistor is configured to determine a value of the reference current.

8. The current source of claim 7, wherein the second circuit comprises a current mirror to the first circuit, and the third circuit comprises an auxiliary current mirror to the first circuit.

9. The current source of claim 7, wherein the first circuit comprises a first metal oxide semiconductor (MOS) transistor having a drain and a gate coupled to the first end of the input resistor and a source configured to be coupled to the ground supply.

10. The current source of claim 9, wherein the second circuit comprises a second MOS transistor having a gate coupled to the gate of the first MOS transistor, a drain configured to be coupled to the load, and a source coupled to the first end of the characteristic resistor.

11. The current source of claim 10, wherein the third circuit comprises a third MOS transistor having a gate coupled to the gate of the first MOS transistor, a drain coupled to the drain of the first MOS transistor, and a source coupled to the source of the second MOS transistor.

12. The current source of claim 7, wherein the first circuit comprises a first bipolar junction transistor (BJT) having a collector and a base coupled to the first end of the input resistor and an emitter configured to be coupled to the ground supply.

13. The current source of claim 12, wherein the second circuit comprises a second BJT transistor having a base coupled to the base of the first BJT transistor, a collector configured to be coupled to the load, and an emitter coupled to the first end of the characteristic resistor.

14. The current source of claim 13, wherein the third circuit comprises a third BJT transistor having a base coupled to the base of the first BJT transistor, a collector coupled to the collector of the first BJT transistor, and an emitter coupled to the emitter of the second BJT transistor.

15. A system comprising:

a load; and a current source comprising:

a first circuit configured to generate a reference current;

a second circuit coupled to the first circuit and the load and configured to:

provide to the load an output current that depends on the reference current; and provide to a characteristic resistor a sink current that is approximately equal to the output current;

the characteristic resistor, having a first end directly coupled to the second circuit and a second end configured to be coupled to a ground supply;

a third circuit coupled to the first and second circuits and the first end of the characteristic resistor, wherein the third circuit is configured to drive a multiple of the output current into the first end of the characteristic resistor; and an input resistor having a first end coupled to the first circuit and a second end configured to be coupled to a power supply, wherein the input resistor is configured to determine a value of the reference current.

16. The system of claim 15, wherein the first circuit comprises a first metal oxide semiconductor (MOS) transistor having a drain and a gate coupled to the first end of the input resistor and a source configured to be coupled to the ground supply.

17. The system of claim 16, wherein the second circuit comprises a second MOS transistor having a gate coupled to the gate of the first MOS transistor, a drain coupled to the load, and a source coupled to the first end of the characteristic resistor.

18. The system of claim 17, wherein the third circuit comprises a third MOS transistor having a gate coupled to the gate of the first MOS transistor, a drain coupled to the drain of the first MOS transistor, and a source coupled to the source of the second MOS transistor.

19. The system of claim 15, wherein the first circuit comprises a first bipolar junction transistor (BJT) having a collector and a base coupled to the first end of the input resistor and an emitter configured to be coupled to the ground supply.

20. The system of claim 19, wherein the second circuit comprises a second BJT transistor having a base coupled to the base of the first BJT transistor, a collector coupled to the load, and an emitter coupled to the first end of the characteristic resistor.

21. The system of claim 20, wherein the third circuit comprises a third BJT transistor having a base coupled to the base of the first BJT transistor, a collector coupled to the collector of the first BJT transistor, and an emitter coupled to the emitter of the second BJT transistor.

22. The method of claim 6, wherein the second circuit comprises a second BJT transistor having a base coupled to the base of the first BJT transistor, a collector coupled to the load, and an emitter coupled to the first end of the characteristic resistor.

23. The method of claim 22, wherein the third circuit comprises a third BJT transistor having a base coupled to the base of the first BJT transistor, a collector coupled to the collector of the first BJT transistor, and an emitter coupled to the emitter of the second BJT transistor.

* * * * *